US005794266A

United States Patent [19]

Han

[11] Patent Number: 5,794,266

[45] Date of Patent: Aug. 18, 1998

[54] GLOVE HAVING PROJECTIONS ON INNER SURFACE

[76] Inventor: Tomtae Young Han, 2844 Orange Ave., La Crescenta, Calif. 91214

[21] Appl. No.: 940,334

[22] Filed: Sep. 30, 1997

[51] Int. Cl.[6] ..... A41D 19/00

[52] U.S. Cl. ..... 2/159; 2/164; 2/163; 2/169

[58] Field of Search ..... 2/159, 161.1, 161.3, 2/161.7, 161.8, 164, 168, 169; 601/40; 36/3 R, 4, 43

[56] References Cited

U.S. PATENT DOCUMENTS

| | | | |
|---|---|---|---|
| 723,348 | 3/1903 | Wilkens | 2/159 X |
| 2,849,786 | 9/1958 | Ashley et al. | 2/159 |
| 3,649,967 | 3/1972 | Millman | 2/161.3 |
| 4,283,244 | 8/1981 | Hashmi | 2/164 X |
| 4,342,121 | 8/1982 | Vistins | 2/164 X |
| 4,497,072 | 2/1985 | Watanabe | 2/161 |
| 4,658,444 | 4/1987 | Figlia et al. | 2/161 |
| 4,727,602 | 3/1988 | Giese et al. | 2/159 X |
| 5,317,759 | 6/1994 | Pierce | 2/161 |
| 5,390,372 | 2/1995 | Hashimoto et al. | 2/164 X |
| 5,500,956 | 3/1996 | Schulkin et al. | 2/159 X |
| 5,625,900 | 5/1997 | Hayes | 2/168 X |

*Primary Examiner*—C. D. Crowder
*Assistant Examiner*—Shirra L. Jenkins

[57] ABSTRACT

A glove made with thin latex or rubber material is suitable for carrying out medical or other delicate procedures while maintaining comfort by creating air pockets inside the glove. The inner layer of the glove has projections or granules so that the contact surface between the glove and the hand is reduced. The glove has a plurality of convexed projections formed on the inner surface so that the convexed projections are in contact with the hand and creates air pockets or buffers in the immediate vicinity of the convexed projections. The glove can be easily made by using a mold having concaved indents or spots and dipping the mold into a pool of liquid latex or rubber and then peeling the glove off of the mold. Each finger tip of the glove may be devoid of the convexed projections to enhance sensitivity.

19 Claims, 4 Drawing Sheets

GLOVE HAVING PROJECTIONS ON INNER SURFACE

BACKGROUND OF THE INVENTION

1. Field of the Invention

This invention relates to a hand glove, and more particularly, to an improved hand glove having projections on inner surface.

2. Description of Related Art

Numerous gloves have been provided that are adapted to be fabricated out of latex rubber material. For example, latex gloves used by medical staffs, such as surgeons, are difficult to don without a lubricating gel or powder. However, the use of such lubricating powder may not be desirable in certain medical procedures since such power might cause undesirable effect.

Once donned with, because of the characteristic of the material, the latex gloves have additional problem of not providing adequate air flow between the latex layer and the hand, thus causing discomfort to the user and precipitating perspiration.

SUMMARY OF THE DISCLOSURE

It is an object of the present invention to provide an improved latex or rubber glove having projections, granules or pillars on its inner surface, which assures adequate ventilation, and a method of making the same.

It is other object of the present invention to provide an improved glove with finger portions devoid of the inner projections to maintain sensitivity required of the glove when such is used in a delicate environment, such as in a surgery.

According to one embodiment of the present invention, the glove includes back and palm portions formed from a flexible material and preferably made of a single integral piece. The flexible material may include natural or synthetic rubber, latex, poly vinyl or other suitable materials. The back and palm portions have outer and inner surfaces, on which a plurality of projections are disposed on the inner surface. However, there are no projections or columns in a region substantially near a finger tip to maintain the agile feature of the glove. The region devoid of the projection may include the areas between the finger tip and either first or second joint of each finger.

The projections may have various shapes and forms, such as convex or pyramid. Alternatively, the projections may be in the form of trenches or grooves.

A method of making a glove having projections protruding on the inner surface according to the present invention comprises the steps of preparing a hand-shaped mold having concaved portions for forming the projections evenly disposed on a surface, except in a region substantially near a finger tip of each finger. The next step is to dip the hand-shaped mold in a rubber solution until the rubber solution coats the hand-shaped mold. After removing and drying the rubber solution coated hand-shaped mold, the glove can be removed from the mold.

These and other aspects, features and advantages of the present invention will be better understood by studying the detailed description in conjunction with the drawings and the accompanying claims.

BRIEF DESCRIPTION OF THE DRAWINGS

A detailed description of embodiments of the invention will be made with reference to the accompanying drawings, wherein like numerals designate corresponding parts in the several figures.

DETAILED DESCRIPTION OF THE PREFERRED EMBODIMENTS

Figure 1:
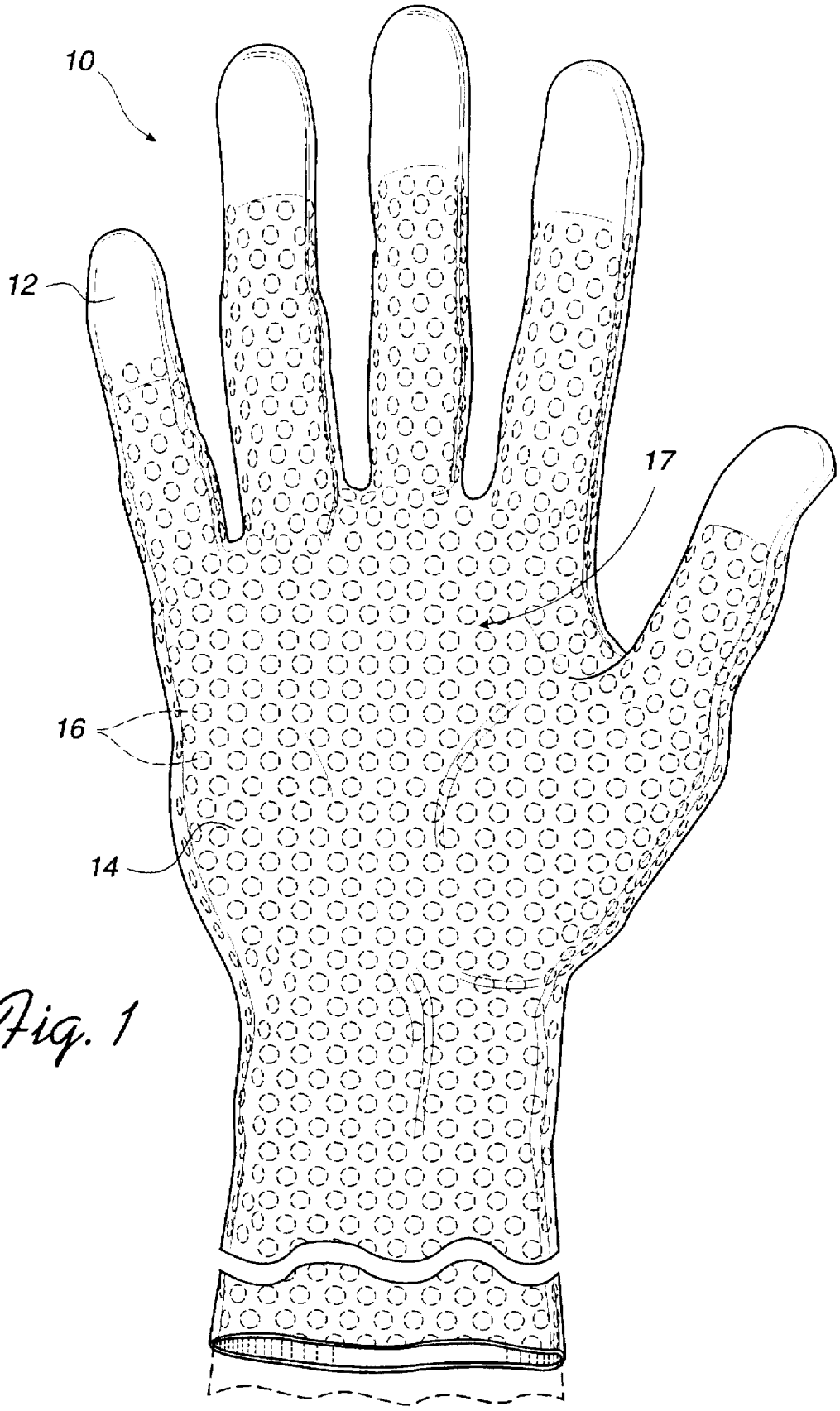
FIG. 1 illustrates a palm side of a glove according to a first embodiment of the present invention.

Referring to FIG. 1, there is provided a glove 10 prepared according to the present invention. The glove 10 according to the present invention is preferably made with thin synthetic or natural rubber, latex, poly vinyl or other suitable materials. FIG. 1 generally illustrates a palm side 17 of the glove 10. The glove 10 includes inner surface portion having projections (or columns or pillars) 14 and no-projection inner surface portion 12. The no-projection inner surface portion 12 preferably constitutes the finger tips, and particularly, in the palm side 17 of the finger tips.

The no-projection inner surface portion 12 is made of the same material as the other portion of the glove 10 and is formed so as to fit the tip of each finger. It is preferably formed so as to fit a portion of each finger between its tip and its first joint. Alternatively, the no-projection inner surface portion 12 may be formed so as to fit a portion of each finger between its tips and its second or third joint.

The inner surface portion having projections 14, which having a similar type fit around the hand, has a plurality of projections 16 protruding from the inner surface of the glove 10. Each one of the projections 16 is separated by a range of predetermined distance, for example, from one-eighth or one-fourth of an inch. However, the separation distance between the projections 16 and the height may be changed depending on the application of the glove 10. Moreover, the projections 16 may be arranged on the glove 10 so that certain portion of the glove 10 which perspires more have higher concentration of projections. For example, there may be more projections formed on the inner surface of the glove 10 which is in contact with the back side of the hand.

The closely space individual projections 16 retain the flexibility and agileness of the glove 10 while providing comfort to the user. In addition, because the contact area of the glove 10 and the hand is substantially reduced due to the presence of air pockets 22 (shown in FIG. 2), the glove 10 is easy to don and remove.

Figure 2:
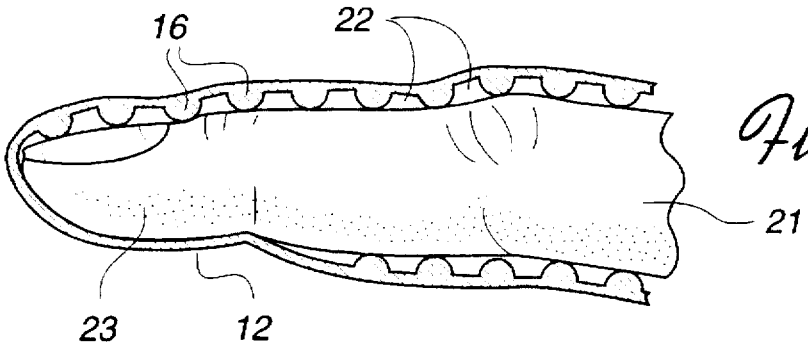
FIG. 2 illustrates a sectional view of one of the finger sections of the glove shown in FIG. 1.

FIG. 2 illustrates a sectional view of the glove 10 showing one of the finger section. As shown, a finger 21 is firmly inserted into a finger portion of the glove 10. On the top side of the finger is in contact with the inner surface portion having projections 16. Between the projections 16, there are provided air pockets 22 or buffer zones for trapping air. As a result, there are many such air pockets 22 surrounding the entire hand which reduces perspiration, and thus, alleviates the glove 10 from slipping from the hand.

Figure 5:
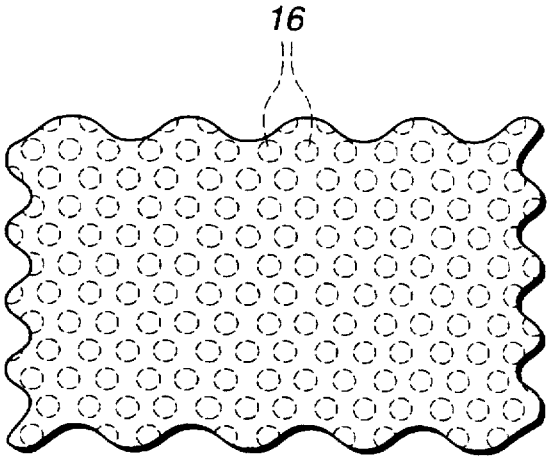
FIG. 5 illustrates a top view of outer surface of a glove of FIG. 1.

FIG. 2 also illustrates the no-projection inner surface portion 12 of the glove 10 which surrounds the palm side 17 of the finger tip 23. The presence of the no-projection inner surface portion 12 is extremely useful when the glove 12 is used in the application requiring precision and sensitivity, such as in medical procedures. Also shown in FIG. 2 is a cross-sectional view of the projection 16. Each projection has a semi-circular or convexed shape. FIG. 5 illustrates a top view of outer surface of the glove 10 having convex projection or pillar which is shown in FIG. 2.

Figure 3:
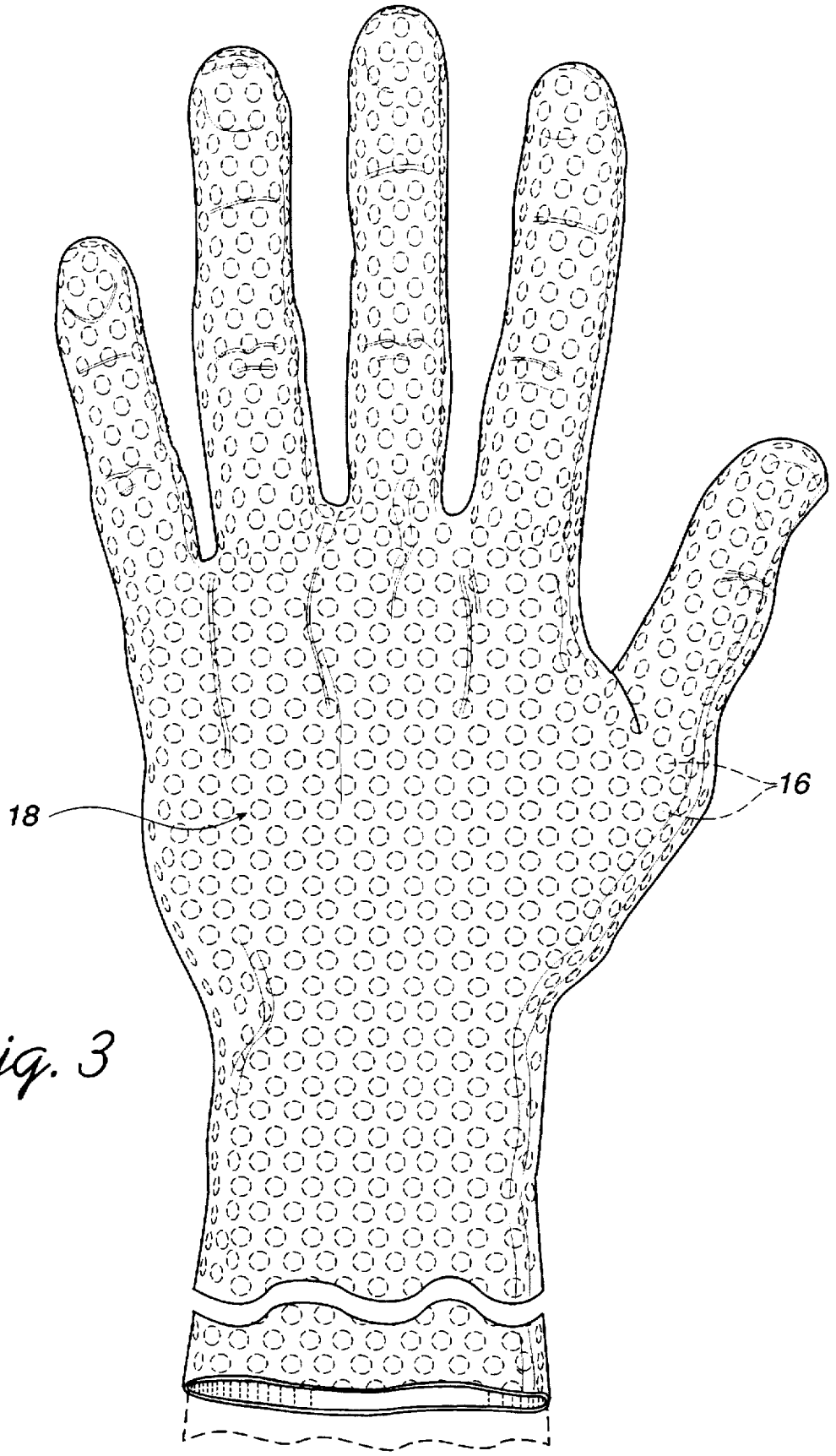
FIG. 3 illustrates a back side of the glove shown in FIG. 1.

FIG. 3 generally illustrates a back side 18 of the glove 10. Similar to the palm side 17 shown in FIG. 1, the back side 18 has a plurality of projections formed on the inner surface. In the preferred embodiment, the only difference is that the formation of the projections 16 on the inner surface of the back side 18 is extended throughout the entire surface, including the areas near the vicinity of the finger tip. However, depending on the application of the present invention, any selective area of the glove 10, including the finger tip, may have no projections 16.

Figure 4:
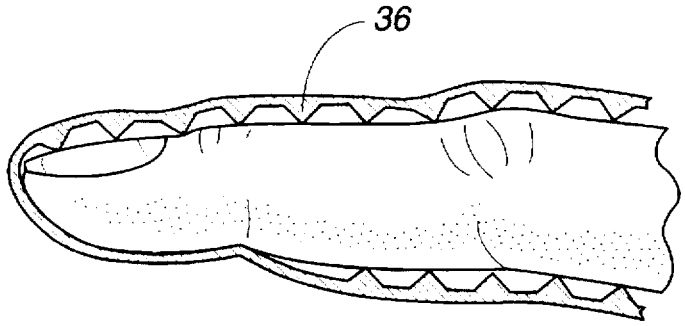
FIG. 4 illustrates a sectional view of one of the finger sections of a glove having pyramid shape projections.
Figure 6:
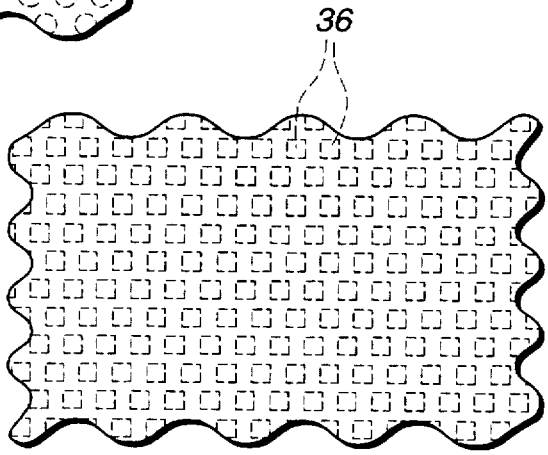
FIG. 6 illustrates a top view of outer surface of a glove of FIG. 4.

FIG. 4 illustrates projections 36 having an alternative shape according to the present invention. In particular, the projection 36 is of a pyramid shape so that the cross-section is substantially a triangle. FIG. 6 illustrates a top view of outer surface of the glove 10 having pyramid projection or pillar which is shown in FIG. 4.

Figure 7:
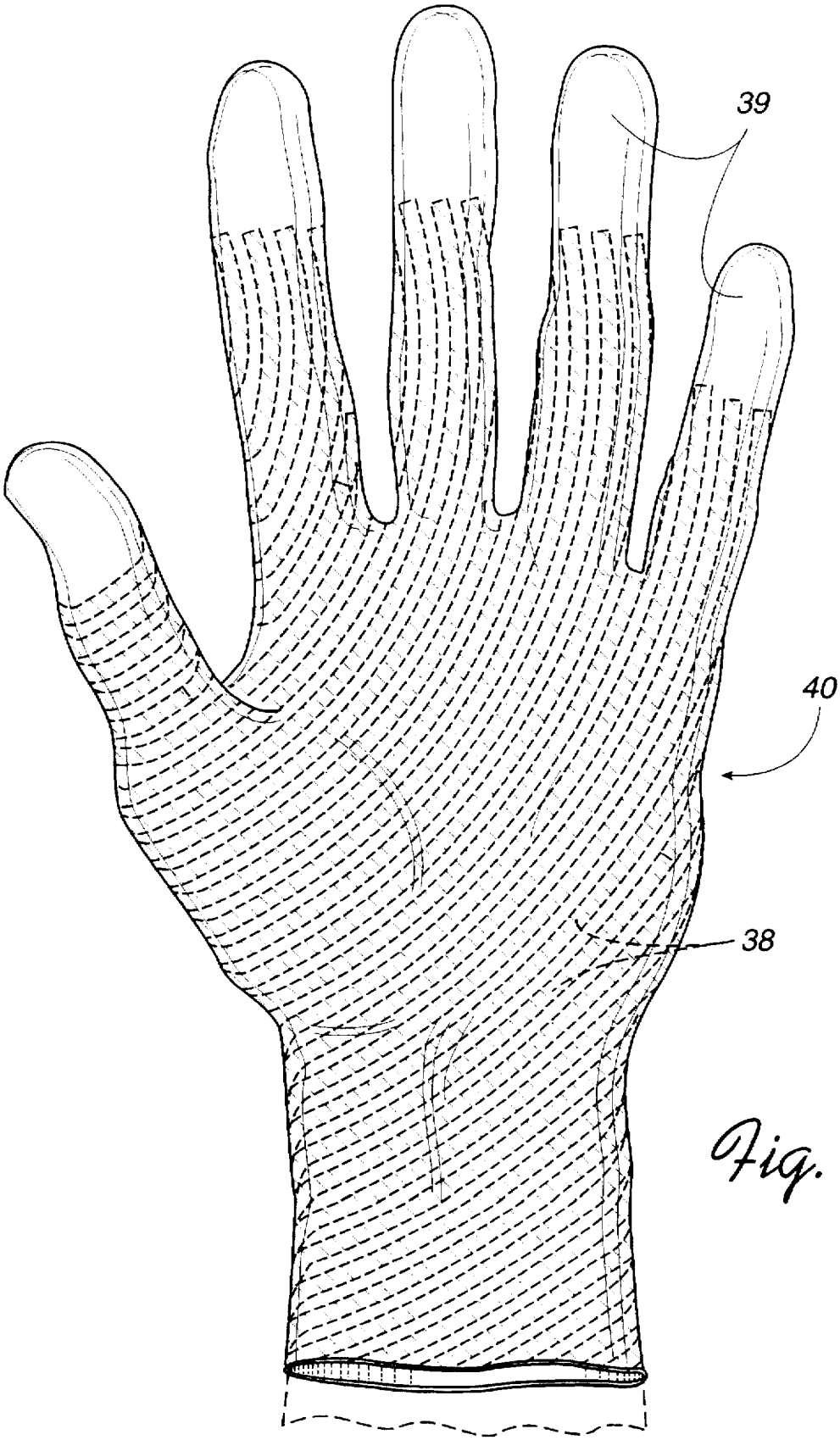
FIG. 7 illustrates a palm side of a glove having groove shaped projections.

FIG. 7 illustrates a palm side of the glove 40 having another alternatively shaped projections 38. In particular, each one of the projections 38 is of a groove or trench shape. Similar to the above embodiments, the areas 39 constituting the finger tip of each finger is devoid of the projections 38.

The glove 10 of the present invention shown in FIG. 1 preserves external tactile feeling needed by the surgeon to securely hold his instruments. This feature is enhanced by the presence of the inner projections. In addition, the sensitivity required by the surgeon is not sacrificed since the most important region, such as finger tips, are not covered with inner projections.

In the manufacturing of the glove 10, a mold is chosen that has a shape of a hand. The glove 10 may be made with both the back and palm of the hand accentuated, thereby allowing the glove to respond freely with the bending of the fingers. When making gloves from regular natural or synthetic rubber, the hand-shaped mold made of a ceramic or other suitable materials, is dipped in a liquid rubber solution. The hand-shaped mold has concaved spots spread evenly on the surface of the mold, except in the palm side of the finger tip region. The concaved spots constitute the inner surface portion having projections.

The hand-shaped mold is then pulled out of the rubber solution and the mold is turned over many times order to produce a uniform thickness. If necessary, the mold may be re-dipped into the rubber solution. The rubber solution adheres to the hand-shaped mold and after the glove is dried, it may be peeled off the mold.

The rubber or latex gloves produced by the method described above provides enhanced comfort level to the user by reducing perspiration while maintaining sensitiveness of the finger tip necessary for the rubber gloves.

While the description above refers to particular embodiments of the present invention, it will be understood that many modifications may be made without departing from the spirit thereof. The accompanying claims are intended to cover such modifications as would fall within the true scope and spirit of the present invention.

For example, the present invention may be used with a finger cot, which is a protective covering for fingers only, where the entire finger cot is covered with inner projections except the region defined by the tip and first joint of a finger. The present invention may also be used with gloves having a long arm sleeve or dishwashing gloves having a flock or fabric-lined interior. In a glove which has a fabric-lined interior, the fabric layer is applied after the inner projections are first formed.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A glove comprising:

a back portion formed from a flexible material, the back portion having outer and inner surfaces, wherein a plurality of projections are disposed on the inner surface; and a palm portion formed from the flexible material and coupled to the back portion so as to form a void for fitting a hand, the palm portion having outer and inner surfaces, wherein a plurality of projections are disposed on the inner surface except in a region substantially near a finger tip.

2. A glove of claim 1, wherein the flexible material is a rubber.

3. A glove of claim 1, wherein each one of the plurality of projections has a shape of convex.

4. A glove of claim 1, wherein each one of the plurality of projections includes grooves protruding from the inner surfaces of the back and palm portions.

5. A glove of claim 1, wherein each one of the plurality of projections has a shape of pyramid.

6. A glove of claim 1, wherein the region devoid of the projections includes an area between a finger tip and first joint of each finger.

7. A glove of claim 1, wherein the region devoid of projections includes an area between a finger tip and second joint of each finger.

8. A glove of claim 1, wherein the back and palm portions of the glove are formed as one integrated piece.

9. A glove of claim 1, wherein the glove has a fabric lining on the inner surfaces of the back and palm portions to substantially cover the plurality of projections.

10. A method of making a glove having projections protruding on the inner surface, the method comprising the steps of:

preparing a hand-shaped mold having concaved portions for forming the projections evenly disposed on a surface, except in a region substantially near a finger tip of each finger;

dipping the hand-shaped mold in a rubber solution until the rubber solution coats the hand-shaped mold;

removing and drying the rubber solution coated hand-shaped mold; and removing the glove from the hand-shaped mold.

11. A method of making a glove of claim 1, wherein the projections include grooves protruding from the inner surface.

12. A method of making a glove of claim 1, wherein each one of the projections has a shape of pyramid.

13. A method of making a glove of claim 1, wherein each one of the projections has a shape of convex.

14. A method of making a glove of claim 1, wherein the region devoid of the projections includes an area between a finger tip and first joint of each finger.

15. A method of making a glove of claim 1, wherein the region devoid of the projections includes an area between a finger tip and second joint of each finger.

16. A protective covering for covering a finger comprising:

a back portion formed from a flexible material, the back portion having outer and inner surfaces, wherein a plurality of projections are disposed on the inner surface; and a palm portion formed from the flexible material and coupled to the back portion so as to form a void for fitting a hand, the palm portion having outer and inner surfaces, wherein a plurality of projections are disposed on the inner surface except in a region substantially near a finger tip.

17. A protective covering of claim 16, wherein the region devoid of the projections is substantially defined as an area between a finger tip and first joint of each finger.

18. A protective covering of claim 16, wherein each one of the plurality of projections includes grooves protruding from the inner surfaces of the back and palm portions.

19. A protective covering of claim 16, wherein each one of the projections has a shape of convex.

* * * * *